US009957775B2

(12) United States Patent
Ferg

(10) Patent No.: US 9,957,775 B2
(45) Date of Patent: May 1, 2018

(54) WELL PLUG AND ABANDONMENT CHOKE INSERT

(71) Applicant: CONOCOPHILLIPS COMPANY, Houston, TX (US)

(72) Inventor: Thomas Eugene Ferg, Stavenger (NO)

(73) Assignee: ConocoPhillips Company, Houston, TX (US)

( * ) Notice: Subject to any disclaimer, the term of this patent is extended or adjusted under 35 U.S.C. 154(b) by 205 days.

(21) Appl. No.: 14/992,217

(22) Filed: Jan. 11, 2016

(65) Prior Publication Data

US 2016/0123110 A1 May 5, 2016

Related U.S. Application Data

(63) Continuation-in-part of application No. 13/371,784, filed on Feb. 13, 2012, now abandoned.

(60) Provisional application No. 61/447,789, filed on Mar. 1, 2011.

(51) Int. Cl.

| | |
|---|---|
| ***E21B 33/13*** | (2006.01) |
| ***E21B 34/06*** | (2006.01) |
| ***E21B 47/06*** | (2012.01) |
| ***E21B 23/08*** | (2006.01) |
| ***E21B 21/10*** | (2006.01) |

(52) U.S. Cl.

CPC ..... *E21B 33/13* (2013.01); *E21B 21/10* (2013.01); *E21B 23/08* (2013.01)

(58) Field of Classification Search

CPC ..... E21B 21/10; E21B 33/16; E21B 33/14; E21B 33/05; E21B 33/13; E21B 23/08; E21B 33/12; E21B 43/10

See application file for complete search history.

(56) References Cited

U.S. PATENT DOCUMENTS

| | | | |
|---|---|---|---|
| 1,339,955 | A | 5/1920 | Jean |
| 2,169,569 | A | 8/1939 | O'Donnell |
| 2,212,086 | A | 8/1940 | Thornhill |

(Continued)

FOREIGN PATENT DOCUMENTS

| | | |
|---|---|---|
| EP | 2053196 | 4/2009 |

OTHER PUBLICATIONS

Halliburton product brochure "Plug Setting Aids" 2009, 14-2 to 14-10.

Schlumberger product brochure "DeepSea Express" 2009.

Weatherford product brochure "Remote-Control Top-Drive Cementing Head (RC-TGH)" 2010.

*Primary Examiner* — Daniel P Stephenson

(74) *Attorney, Agent, or Firm* — Boulware & Valoir

(57) ABSTRACT

A process for plugging a wellbore, e.g. an oil or gas well, comprises installing a choke device (1) into the wellbore in order to increase the back pressure to allow better control when introducing cement to plug the wellbore. The device (1) has a cylindrical shape with a central through bore (6). On the external profile is a shoulder (4) which, when the device is installed in a wellbore, comes to rest against a nipple in the wellbore. The device (1) may free fall for all or part of the way down but would normally be pumped down at least for the last part of its delivery. In the bore (6) is a pump out ball (10) which blocks the through bore until the device reaches the nipple and stops, at which point pressure increases and the ball is ejected. Cement and other liquid may then be pumped through the choke device to the distal region of the well.

16 Claims, 3 Drawing Sheets

(56) References Cited

U.S. PATENT DOCUMENTS

| | | | | | |
|---|---|---|---|---|---|
| 2,263,566 | A | | 11/1941 | Boynton | |
| 2,382,578 | A | | 8/1945 | Penick | |
| 2,274,093 | A | | 8/1951 | Sailers | |
| 3,059,469 | A | * | 10/1962 | Caldwell | E21B 47/0003 166/151 |
| 4,589,495 | A | | 5/1986 | Langer | |
| 5,095,988 | A | | 3/1992 | Bode | |
| 5,277,255 | A | * | 1/1994 | Bell | E21B 17/06 166/290 |
| 5,829,523 | A | | 11/1998 | North | |
| 5,890,537 | A | | 4/1999 | Lavaure | |
| 5,950,724 | A | | 9/1999 | Giebeler | |
| 6,279,654 | B1 | | 8/2001 | Mosing | |
| 6,520,256 | B2 | | 2/2003 | Ferg | |
| 6,951,246 | B2 | | 10/2005 | Tessier | |
| 7,275,595 | B2 | | 10/2007 | Tocalino | |
| 2002/0153138 | A1 | | 10/2002 | Ferg | |
| 2009/0151960 | A1 | | 6/2009 | Rogers | |
| 2009/0260816 | A1 | | 10/2009 | Webb | |
| 2011/0146986 | A1 | * | 6/2011 | Giem | E21B 33/16 166/291 |
| 2012/0222862 | A1 | * | 9/2012 | Ferg | E21B 21/10 166/294 |
| 2015/0129203 | A1 | * | 5/2015 | Deutch | E21B 43/11 166/250.1 |
| 2016/0123110 | A1 | * | 5/2016 | Ferg | E21B 33/13 166/250.01 |

* cited by examiner

WELL PLUG AND ABANDONMENT CHOKE INSERT

CROSS REFERENCE TO RELATED APPLICATIONS

This application is a continuation-in-part of U.S. Non-provisional application Ser. No. 13/371,784, filed Feb. 13, 2012, which claims the benefit of and priority to U.S. Provisional Application Ser. No. 61/447,789 filed Mar. 1, 2011. Each of these applications is incorporated herein by reference in its entirety for all purposes.

FIELD OF THE INVENTION

This invention relates to a method and apparatus for plugging a wellbore (such as e.g. an oil or gas well), or for preparing a wellbore to be plugged, e.g. when it has reached the end of its productive life. The invention also relates to a plugged wellbore.

BACKGROUND OF THE INVENTION

When an oil or gas well is no longer economical or if there is some problem with the well which means that production is no longer possible or that well integrity has been compromised in some way, or for other reasons, the well may be abandoned. It is common practice to plug the well before abandoning it, e.g. to prevent seepage of hydrocarbon product from the well. This can also apply to water injectors, i.e. bores which have been drilled in order to pump water into a reservoir to increase bottom hole pressure.

Commonly, plugging may be achieved by injecting a settable substance or medium, e.g. cement, into the well. A well will normally have production perforations, that is to say apertures in a well liner or casing through which hydrocarbon product enters from the rock formation and travels to the surface. During plug and abandonment operations it is common to seal ("squeeze") production perforations with cement or another settable medium, which may then form a permanent barrier to flow across the perforations and out of the well.

The plugging process often involves pumping a surfactant liquid, known as a "spacer", into the well. The purpose of the spacer is to remove oil residues from the internal surface of the well casing and/or liner and rock matrix making them "water wet" (allowing better adhesion by cement). Commonly, immediately following the spacer, cement is pumped down the well to occupy the part of the well casing and/or liner where perforations are to be squeezed. When sufficient cement has been pumped down, more spacer liquid and possibly other liquids may be pumped down the well in order to place the cement at its final designed location.

It is desirable to be able to monitor with a reasonable degree of accuracy where the different constituents of the liquid column are located at any given time and the associated surface pumping (treating) pressure. It is also desirable to be able to control the progress of the liquid column, and other things, by varying pressure on the column applied at the surface. For these things to be achieved, it is helpful to have a continuous column of liquid being pumped into the well.

It is therefore desirable to have sufficient reservoir pressure entering the well ("bottom hole pressure") to support a standing column of relatively high specific gravity material, e.g. spacer liquid, cement and displacement fluid, reaching to the top of the well. The spacer and cement and other liquids may then be pumped down against this pressure and thereby an accurate determination of each constituent's location be made at any given point within the process.

In many cases, the bottom hole pressure is insufficient to support a standing column of relatively high specific gravity liquid reaching to the top of the well. In this event, positive pressure against the fluid column at the surface cannot be maintained as liquids are introduced into the top of the well. This results in liquid free falling down the wellbore and out through the reservoir completion, i.e. the perforated section of casing/liner.

In this situation, it is often not possible to monitor when the cement has reached the desired wellbore location with respect to the perforations, which are desired to be sealed. Without an accurate understanding of where the cement is, it is possible to over-displace the cement by continuing to introduce fluid at the surface which freefalls and over displaces the cement, with the result that the proximal perforations are not effectively squeezed. Alternatively, it is possible to under-displace the cement thereby leaving distal perforations unplugged and at the same time creating a barrier in the more proximal part of the liner hindering further optimized plugging operations within the wellbore without revision to procedures.

In the past, attempts have been made to address this issue by the addition of solid plugging material to the liquid plugging fluid or by displacement of the liquid plugging fluid with a low specific gravity fluid.

The addition of solid plugging material partially closes off pathways at the perforations creating backpressure or the need for additional pumping pressure at the surface in order to displace the plugging to the desired location. Thus, a positive pressure on the fluid column is maintained at the surface. Partly closing perforations with solid material can be undesirable since the perforations can end up inadequately plugged. Conversely, because there is little control over the degree of plugging and at which point it will occur, an undesirable outcome can result if all perforations are plugged off with medium prior to achieving designed displacement.

Similarly, displacement of the plugging fluid with a significantly lower specific gravity fluid may also allow positive pressure to be maintained at the surface. However, there is a limit in available low specific gravity fluids and the constituents incorporated in them that meet design requirements.

U.S. Pat. No. 6,520,256 discloses a choke for use in cementing casings in oil and gas wells.

BRIEF SUMMARY OF THE DISCLOSURE

The invention includes a method for plugging a wellbore of a predetermined volume and utilizing a choke device to control the settable medium being injected thereto. Specifically, the process comprises the steps of (a) installing a choke device into the wellbore, the device having a through bore with a predetermined diameter, (b) determining the volume of the wellbore tubulars, liners, and perforations in the liners for the space being plugged; (c) injecting a controlled amount of settable medium into the wellbore, wherein the amount is based on the volume of the wellbore tubulars, liner and perforations in the liners, and (d) plugging the wellbore. Specific choke device configurations are also disclosed.

Injections of settable media, such as cement, are frequently made in the wellbore to line a well or annulus. Such applications only require calculating the cross-section of the well and determining the amount of cement needed to obtain a given thickness for the cement lining. However, the presently disclosed methods are directed to plugging a wellbore, including wellbores with perforated liners. This distinction is important because different volume considerations and calculations are needed to obtain the correct amount of settable medium. When lining a well, an excess or dearth of settable media results in a thicker or thinner lining. However, when plugging a wellbore, the injection of too much settable medium or not enough settable media can have negative effects on wellbore plugging. Errors in displacement can result in partially plugged perforations, plugged perforations in the distal part of the wellbore but not the proximal portion, plugged perforations in the proximal portion and blocked access to the distal portion with open perforations and the like. Thus, the present methods operate in a tight window to ensure a proper amount of settable medium is injected to effectively squeeze the wellbore.

By using the choke device and calculating the volume of the wellbore tubulars, the liners, and perforations in the liners, an appropriate amount of settable media can be squeezed into the desired perforations and tubulars without over- or under-displacing the settable media column.

Any settable medium can be used and can include major components such as cement (e.g. Portland cement, hydraulic cement, slag cement and the like), cement kiln dust, pumice, and/or ash.

The invention is particularly applicable when the bottom hole pressure of the wellbore is insufficient to support a standing column of liquid having specific gravity of about 1 from reaching to the surface.

The choke device may be installed by allowing it to free fall down the well or it may be pumped down the well, or a combination of the two. If the wellbore includes a nipple, the choke device may bottom out at the nipple.

The choke device itself may also comprise a body capable of being passed down a wellbore. The body may have an external profile including a shoulder, a through bore and a pump out valve, which blocks the through bore until a predetermined pressure is applied to the valve. The pump out valve may be a ball retained in the through bore by a stop surface. Seals may be provided on the external profile of the body.

In one embodiment, the choke device includes a pump out valve. When the device reaches the nipple and stops, pumping is continued thereby increasing pressure until the pump out valve is actuated, thereby allowing flow of fluid through the device. The pump out valve may be thought of as a device for blocking the through bore until a predetermined pressure is applied e.g. on the proximal side of the valve. The valve may be an arrangement as simple as a deformable plug of spherical or other shape which is located in the through bore between two shoulders; when the pressure increases beyond a certain level the plug is forced out thereby opening the bore for liquid to flow through it.

If a christmas tree is located at the top of the wellbore, the step of installing the choke device may include inserting the device between the swab valve and the master valve (top or bottom master valve) and then opening the necessary valves below the device to gain access to the wellbore.

To plug the wellbore, one or more settable medium (such as cement-based media) may be injected into the wellbore, through the choke device, and into the distal part of the wellbore, that is to say the part beyond the choke device. Surfactant may be injected into the wellbore before the settable liquid, and another fluid may be injected after. The pressure at the surface would normally be monitored, as it may be possible to determine from the monitored pressure when the settable medium reaches the choke device.

A method of preparing a wellbore for plugging may comprise inserting into the wellbore a choke device as described above. The method may include applying pressure to the choke device, thereby pumping the device through the wellbore and subsequently increasing the pressure to a level at which the pump out valve is actuated and the through bore unblocked. This preferably happens when the device has reached a nipple in the wellbore, e.g. adjacent a production packer. Once in place, a predetermined amount of settable medium can be injected into the wellbore where it will flow through the choke device. The choke device will control the pressure and volume entering the space below the choke, which will allow the settable medium to plug the wellbore without being flushed into the reservoir.

The invention also relates to a plugged wellbore having located in it a choke device as described above.

The present methods includes any of the following embodiments in any combination(s) of one or more thereof:

A process for plugging a wellbore comprising the steps of installing a choke device having a through bore with a predetermined diameter into the wellbore, determining a volume of wellbore tubulars and a volume of a perforated liner and its perforations, injecting a controlled, known volume of settable medium into the wellbore, wherein the volume of the settable medium is based upon the determined volume of the wellbore tubulars, perforated liner, and liner holes, and plugging the wellbore with the settable medium.

The wellbore may have a proximal part defined between the choke device and the surface and a distal part defined between the choke device and the distal end of the wellbore so that the step of injecting a settable medium comprises injecting some or all of the settable medium through the choke device into the distal part of the wellbore.

In more detail, the choke device can have a body capable of being passed down a wellbore, wherein the body has an external profile which includes a shoulder; a through bore; and a pump out valve which blocks the through bore until a predetermined level of pressure is applied to the valve. The through bore can include a stop surface and the pump out valve can have a ball retained in the through bore by the stop surface. One or more seals may be provided on the external profile of the body.

A method of preparing a wellbore to be plugged comprising (i) inserting into the well a choke device, wherein the device comprises a body capable of being passed down a wellbore, wherein the body has an external profile which includes a shoulder a through bore, and a pump out valve which blocks the through bore until a predetermined level of pressure is applied to the valve; and (ii) determining the volume of wellbore tubulars and a volume of a perforated liner, including perforations, to control a volume of a settable medium to be injected into the wellbore.

Additional steps in this method include applying pressure at a first level to the choke device, wherein the pressure is below a predetermined pressure level, thereby pumping the device through the wellbore; and subsequently applying pressure to the choke device at a second level at or above the predetermined level, whereby the pump out valve is activated and the through bore unblocked. In any of these methods, the choke device can be pumped through the wellbore until it reaches a nipple, which may be adjacent to a production packer of the wellbore.

A plugged wellbore having located therein a choke device, wherein the choke device has a body capable of being passed down a wellbore, wherein the body has an external profile that includes a shoulder, a through bore, and a pump out valve which blocks the through bore until a predetermined level of pressure is applied to the valve.

In any of the above methods, the choke device can be installed by allowing the choke device to free fall down the wellbore or by pumping the choke device down the wellbore. If the wellbore includes a nipple, then the choke device can be installed so that it bottoms out at the nipple. In some embodiments, the choke device can include a pump out valve and the step of installing the choke device includes pumping the choke device down the wellbore until it bottoms out at the nipple and then continuing to pump thereby increasing pressure on the device until the pump out valve is actuated.

In some embodiments, the wellbore has a christmas tree located at the top of the wellbore. If the christmas tree has a swab valve and a master valve, then installing the choke device comprises inserting the choke device between the swab valve and the master valve and then opening the master valve to allow the device to enter the wellbore.

This process can also be used when the bottom hole pressure of the wellbore is insufficient to support a standing column of liquid of specific gravity 1 reaching to the surface. In some embodiments, a surfactant liquid is injecting into the wellbore prior to injecting the settable medium. In other embodiments, a third liquid is used after injecting the settable medium. The pressure at the surface can be monitored for the surfactant liquid, settable medium and/or third liquid, which can help determine when the settable medium has reached the choke device.

This summary is provided to introduce a selection of concepts that are further described below in the detailed description. This summary is not intended to identify key or essential features of the claimed subject matter, nor is it intended to be used as an aid in limiting the scope of the claimed subject matter.

The term "wellbore" as used herein shall be taken to mean an oil or gas well or a water injector.

As used herein, the term "settable fluid" or "settable medium" are used interchangeable and are taken to mean a composition that over time sets to form a hardened mass. It should be noted that the medium can include other fluids such as water, brine, salt water, sea water and the like to improve flow of the major components through the wellbore.

The settable medium can contain additional additives such as fly ash, metakaolin, shale, zeolite, gas, crystalline silica, amorphous silica, salt, fiber, hydratable clay, microspheres, pozzolan, lime, latex cement, and combinations thereof.

As used herein, the term "fluid" or "liquid" are used interchangeable to denote a free flowing substance of constant volume.

As used herein, volume of the perforated liner includes the interior volume of the cylindrical shape of the liner plus the volume of any perforations (area of the perforation× thickness of liner) in the liner. Typically, liners have one perforation shape that repeats over the length of the liner, thus resulting in one volume equation multiplied by the number of perforations. However, liners can have multiple shapes and patterns, resulting in the use of more than one volume equation for the perforations.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

BRIEF DESCRIPTION OF THE DRAWINGS

A more complete understanding of the present invention and benefits thereof may be acquired by referring to the following description taken in conjunction with the accompanying drawings in which.

DETAILED DESCRIPTION

Turning now to the detailed description of the preferred arrangement or arrangements of the presently disclosed methods, it should be understood that the inventive features and concepts may be manifested in other arrangements and that the scope of the invention is not limited to the embodiments described or illustrated below. The scope of the invention is intended only to be limited by the scope of the claims that follow.

First, the volumes of the wellbore tubulars and the perforated liner to be plugged are determined so the volume of settable medium column pumped down the well can be controlled to give the best chance of filling the perforated liner with settable medium without over- or under-displacing the settable medium column. For tubulars, the volume is calculated using the equation for a cylinder: $Pi*r^2*h$, wherein r is the radius and h is height. The volume of each tubular being plugged will be added together.

For the perforated liners, the same equation for the cylinder can be used for the base structure, however additional measurements to account for the perforations must be added thereto. Volume calculations for a variety of shapes are well known and can be applied to the various perforations shapes in a liner. In many cases, liners come prestamped with a particular shape(s) in a particular pattern and with a particular number of perforations. Thus, the volume for each shape can be calculated and multiplied by the number of perforations of that shape and added to the base volume of the cylinder.

Before plugging a well, sea water is pumped into the well to determine whether it is possible to inject liquid into the perforations in the producing part of the well (not shown) which it is desired to squeeze (block with cement or other settable plugging fluid). A gauge device, of diameter and length determined by the choke insert and the wellbore tubular being traversed, is also lowered into the well to determine whether any obstructions are present which may obstruct and prevent the correct positioning of the choke insert.

Once the wellbore is considered conducive to plugging, the choke device is introduced into the wellbore.

Figure 1:
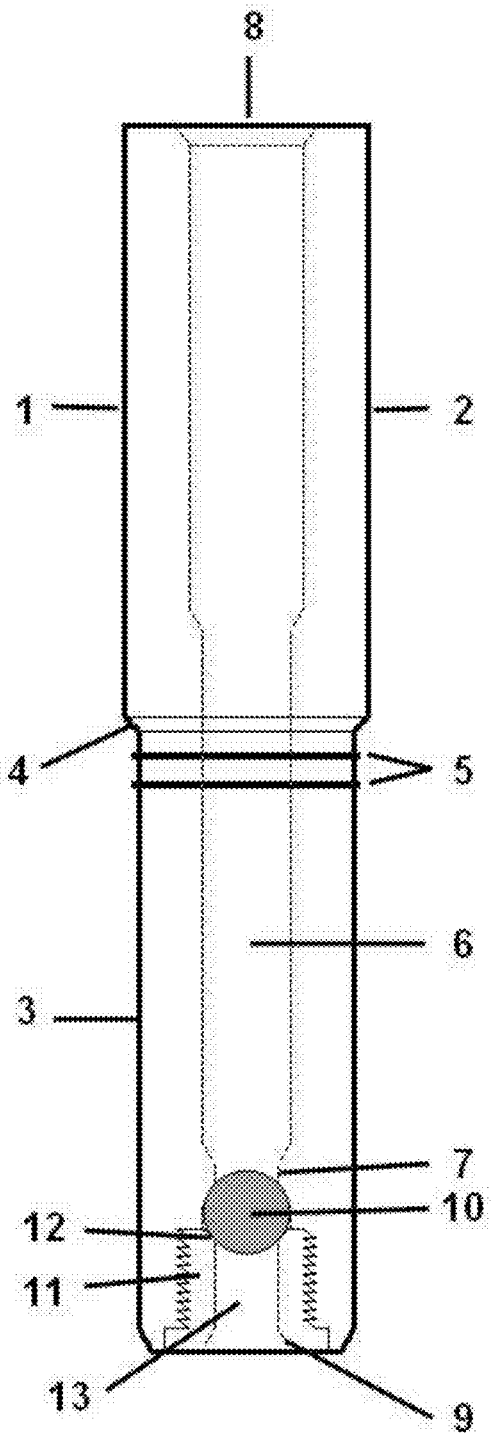
FIG. 1 is a side view of a choke insert in accordance with the invention.

FIG. 1 shows a choke insert 1 having a generally cylindrical shaped, cast body of aluminum. Its outer profile includes a proximal portion 2 and a distal portion 3 of reduced diameter compared with the proximal portion. The words "proximal" and "distal" relate to the orientation of the device when in place in a well: the proximal portion being closer to the surface and the distal portion closer to the end of the well.

Between the proximal and distal portions is a shoulder 4. On the outer profile in the reduced diameter distal portion are two seals 5. The function of the seals 5 is to restrict fluid flow around the outside of the insert 1 such that all flow is directed through the device, not around it. Extending through the device is a bore 6 having a diameter that decreases towards the distal end of the device; at its most distal end, the bore 6 has a diameter 7 as shown in FIG. 1. The bore 6 is provided with a flared proximal end 8, to help to reduce turbulence within the fluid flow regime.

An end plug 11 is screwed into the distal end of the bore of the insert 1 which provides an internal shoulder or stop surface 12. The end plug has a bore 13 of the same diameter 7 as the most distal part of the bore 6 through the main body of the choke insert 1. The bore 13 also has a flared end 9 to help reduce turbulence.

Located on the proximal side of the end plug 11 is a ball 10 of phenolic plastic which sits adjacent the stop surface 12. The ball 10 is retained between the stop surface 12 and the distal end of the bore 6 in the main body. The dimensions and elastic modulus of the ball are carefully established, relative to the diameter 7, such that the ball will deform and pass the stop surface 12 if a predetermined pressure is applied to the proximal side of the ball 10.

Figure 2:
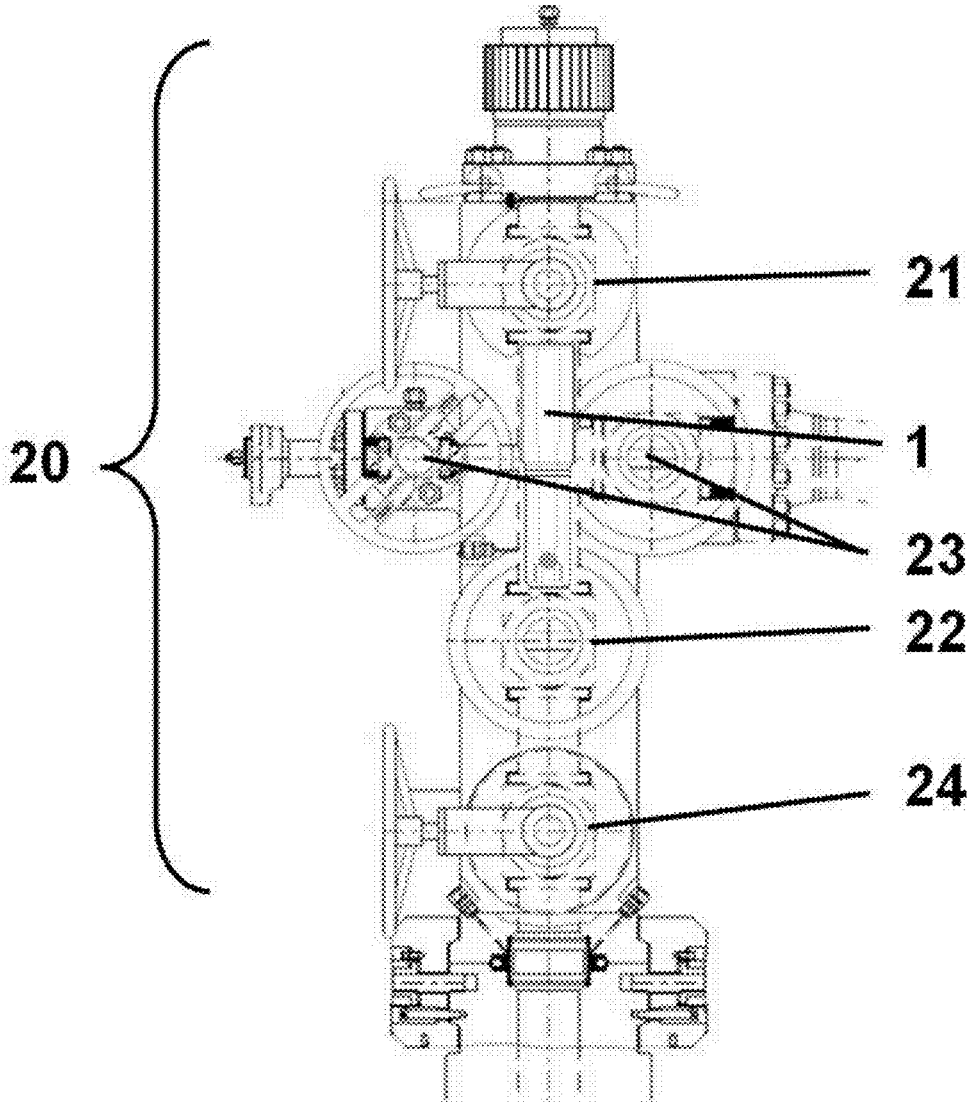
FIG. 2 is a side view, partly in section, of a well christmas tree showing the choke insert of FIG. 1 in place.
Figure 3:
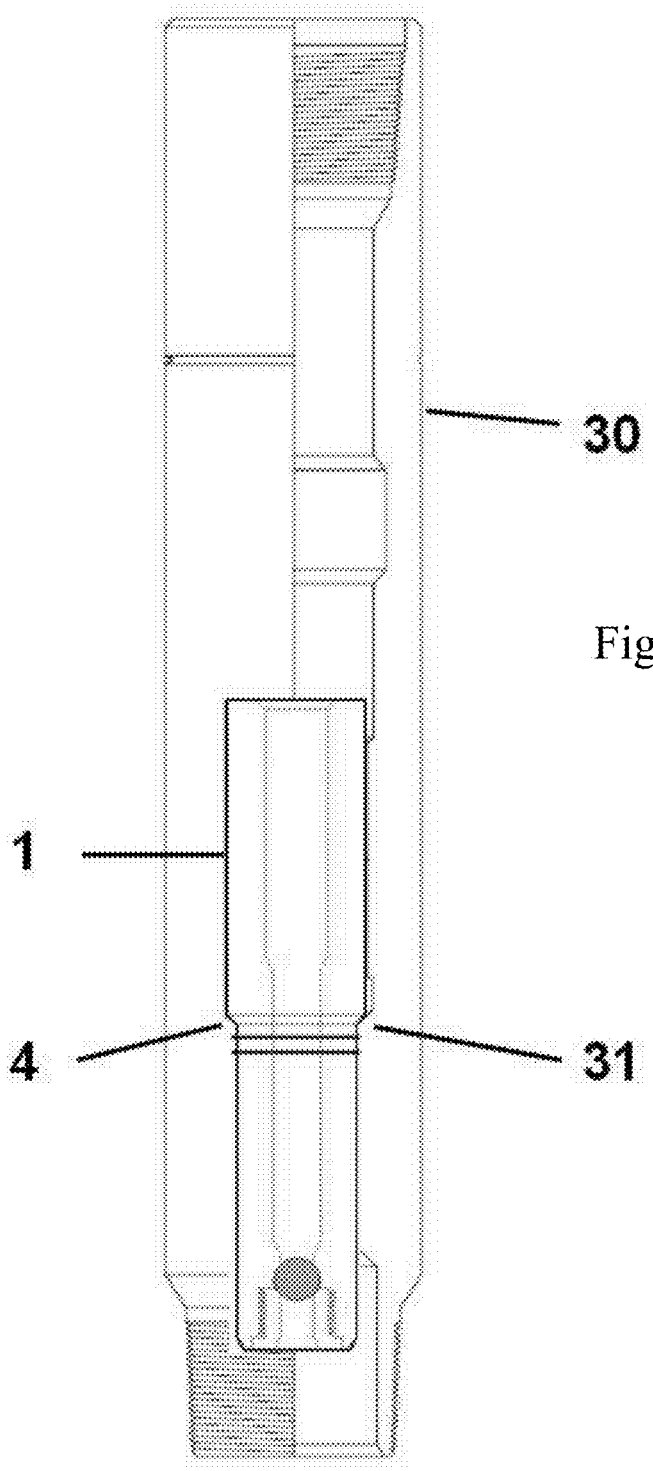
FIG. 3 is a side view, partly in section, of part of a wellbore showing the choke insert of FIG. 1 located against a nipple in the wellbore.

FIG. 2 shows a christmas tree valve arrangement at the top of a wellbore to be plugged. Such a valve arrangement is often used in wellbores. The length of the choke insert 1 is chosen so that it will fit into the christmas tree 20 between the swab valve 21 and the upper master valve 22. The overall outer diameter is chosen so that it will pass down the well to a point just above the reservoir. The dimensions of the distal portion 3 and the shoulder 4 are chosen so that the choke insert device 1 will rest against a nipple 31 (see FIG. 3) in the wellbore 30 in region of the top of the reservoir, near the production packer (not shown).

To introduce the choke insert 1, the bottom master valves and swab valve are closed and any trapped pressure is bled off between them at the wing valve 23. The swab valve is then opened and the choke insert 1 is inserted into the christmas tree 20, the swab valve 21 closed, and then the bottom and upper master valves 24, 22 are opened. The choke insert 1 then free falls down the well.

In a simple vertical well, the choke may reach the desired location (nipple 31) without pumping. Normally, however, the friction will be too great and/or the well has an inclined or horizontal portion and the choke insert has to be pumped. Sea water is normally used for this purpose. Pumping continues until an increase in back pressure is noted, which is indicative of the choke having come to rest at the profile nipple 31. Pumping is continued until the pressure rises sufficiently to displace the ball 10 past the stop surface 12. A sudden drop in monitored pressure indicates that the ball has been displaced. Step rate tests are then conducted to determine the back-pressure created by the choke at increasing injection rates. This data is used to refine the predicted surface treating pressure profile that should be experienced during the placing of the plugging fluid.

Spacer fluid, a specialized mixture of chemicals including surfactants, is then pumped down the well at a rate sufficient to maintain positive pressure and contact with the top of the fluid column. The choke insert 1 with its small diameter bore, allows the fluid column to maintain the positive back pressure. A settable medium, such as cement, is then delivered in a continuous liquid column directly following the spacer fluid. Additional liquid or liquids, e.g. further spacer fluid or other liquids, follow the cement in a continuous liquid column. Pressure continues to be applied to the settable medium via this liquid column, and monitoring of back pressure continues.

As the spacer/settable medium interface passes the choke insert 1, a pressure change may be recorded at surface due to its unique viscosity and density. When the other end of the settable medium column passes the choke insert 1, a further change in surface pressure may be noted due to its unique viscosity and density.

In closing, it should be noted that the discussion of any reference is not an admission that it is prior art to the present invention, especially any reference that may have a publication date after the priority date of this application. At the same time, each and every claim below is hereby incorporated into this detailed description or specification as an additional embodiment of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A process for plugging a wellbore, wherein the process comprises the steps of:

a) installing a choke device into a wellbore tubular, the choke device having a through bore with a predetermined diameter;

b) determining a volume inside said wellbore tubular plus a volume of perforations in said wellbore tubular;

c) injecting a settable medium into the wellbore, wherein a volume of the settable medium injected into the wellbore is controlled based upon the determined volume inside said wellbore tubulars plus the volume of the perforations; and, d) plugging said wellbore.

2. The process according to claim 1, wherein the bottom hole pressure of the wellbore is insufficient to support a standing column of liquid of specific gravity 1 reaching to the surface.

3. The process according to claim 1, wherein the step of installing the choke device comprises allowing the choke device to free fall down the wellbore.

4. The process according to claim 1, wherein the step of installing the choke device comprises pumping the choke device down the wellbore.

5. The process according to claim 1, wherein the wellbore includes a nipple and wherein the step of installing the choke device comprises having the choke device bottom out at the nipple.

6. The process according to claim 5, wherein the choke device includes a pump out valve and the step of installing the choke device comprises pumping the choke device down the wellbore until it bottoms out at the nipple and then continuing to pump thereby increasing pressure on the choke device until the pump out valve is actuated.

7. The process according to claim 1, wherein located at the top of the wellbore is a christmas tree with a swab valve and a master valve and wherein the step of installing the choke device comprises inserting the choke device between the swab valve and the master valve and then opening the master valve to allow the choke device to enter the wellbore.

8. The process according to claim 1, wherein a proximal part of the wellbore is defined between the choke device and the surface and a distal part of the wellbore is defined between the choke device and the distal end of the wellbore and wherein the step of injecting a settable medium comprises injecting some or all of the settable medium through the choke device into the distal part of the wellbore.

9. The process according to claim 1, further comprising the step of injecting a surfactant liquid into the wellbore prior to injecting the settable medium.

10. The process according to claim 9, further comprising the step of injecting a third liquid after injecting the settable medium.

11. The process of claim 10, comprising monitoring pressure at the surface of surfactant liquid, settable medium and third liquid.

12. The process of claim 11, further comprising determining from said monitored surface pressure when the settable medium reaches the choke device.

13. A method of preparing a wellbore to be plugged comprising:

(i) inserting into the well a choke device, wherein the choke device comprises a body capable of being passed down a wellbore, wherein the body has:
   a) an external profile which includes a shoulder;
   b) a through bore;
   c) a pump out valve which blocks the through bore until a predetermined level of pressure is applied to the valve; and (ii) determining a volume inside wellbore tubulars and a volume of perforations in said tubulars to control a volume of a settable medium to be injected into the wellbore.

14. The method according to claim 13, further comprising the steps of:

(i) applying pressure at a first level to the choke device, said pressure being below said predetermined pressure level, thereby pumping the choke device through the wellbore; and, (ii) subsequently applying pressure to the choke device at a second level at or above said predetermined level, whereby said pump out valve is activated and the through bore unblocked.

15. The method according to claim 14, wherein, in step a), the choke device is pumped through the wellbore until it reaches a nipple.

16. The method according to claim 15, wherein the nipple is adjacent to a production packer of the wellbore.

* * * * *